United States Patent [19]

Driscoll et al.

[11] 4,426,245

[45] Jan. 17, 1984

[54] MASKING APRON DISPENSING APPARATUS

[76] Inventors: Michael E. Driscoll; Wilson O. Boozer, III, both of P.O. Box 12194, Gainesville, Fla. 32604

[21] Appl. No.: 468,755

[22] Filed: Feb. 22, 1983

[51] Int. Cl.[3] ..... B31F 5/06; B32B 31/18

[52] U.S. Cl. ..... 156/511; 156/516; 156/554; 225/38

[58] Field of Search ..... 156/554, 511, 510, 516, 156/527, 545; 225/38, 34

[56] References Cited

U.S. PATENT DOCUMENTS

| | | | |
|---|---|---|---|
| 2,593,325 | 4/1952 | Mathews | 225/38 |
| 2,916,078 | 12/1959 | Herbert, Jr. | 156/554 |
| 3,152,032 | 10/1964 | Waltz | 156/554 |
| 3,553,060 | 1/1971 | Waltz | 156/554 |
| 3,630,421 | 12/1971 | Waltz | 225/21 |
| 3,847,709 | 11/1974 | Martin | 156/554 |
| 4,052,248 | 10/1977 | Hunter | 156/554 |

*Primary Examiner*—Michael G. Wityshyn
*Attorney, Agent, or Firm*—Anthony J. DeLaurentis

[57] ABSTRACT

A masking apron dispensing apparatus comprises a base, a generally upwardly extending support shaft mounted to the base, and at least one paper roll support unit mounted to the support shaft and extending generally perpendicularly therefrom; each paper roll support unit further comprising means for supporting a roll of masking tape adjacent at least one end of the paper roll support unit, means for facilitating positive pressure engagement of the tape against a roll of paper supported on the support unit, and cutter bar means for severing the paper and tape to a desired length. Each of the paper roll support shaft units may support two or more paper rolls and each may support two or more rolls of masking tape. As an alternative embodiment, a hand-carried single paper roll support shaft dispenser is also disclosed.

13 Claims, 5 Drawing Figures

MASKING APRON DISPENSING APPARATUS

BACKGROUND OF THE INVENTION

The invention is directed to an apparatus for dispensing a length of paper having a strip of masking tape adhered along at least one of the longitudinal edges thereof. More particularly, the invention is directed at simulateously dispensing paper and masking tape from a hand-carried, or pulled, dispenser apparatus capable of accommodating different size rolls of paper such that one or both edges of the dispensed paper is provided with a strip of masking tape.

It is often necessary prior to painting an object, such as an automobile or a house, to mask areas of the object which are not to be painted. To this end it is convenient to use a "masking machine", sometimes called an apron taper stand, which automatically connects a strip of masking tape to the edge of a length of masking paper, thus creating an apron.

Historically, there have been many machines developed for dispensing masking paper, automatically adhering pressure sensitive tape to one edge of the paper to form the apron, and cutting the apron from the rolls of paper and tape. Many of the units have been heavy, cumbersome and difficult to move.

More recently units have been developed that feature easier mobility and the ability to hold several different rolls of masking paper on the same unit. Recent units also have been developed which can be adapted to apply tape simultaneously to both edges of the dispensed paper. However, these units generally require the purchase of extension tubes so that the units may be utilized for paper rolls which are wider than those contemplated by a given unit's original design, provided, of course, that the unit can be adapted at all. Still other units have required the purchase of cumbersome and costly stands to facilitate their mobility. Also, unfortunately, it has been necessary, with the units that can be adapted to tape both edges of the paper simultaneously, to buy expensive and time consuming kits in order to utilize the unit for this purpose.

Examples of prior art paper and tape dispensing units are described in U.S. Pat. No. 4,052,248 to Hunter; U.S. Pat. No. 3,553,060 to Waltz; U.S. Pat. No. 3,847,709 to Martin; U.S. Pat. No. 2,593,325 to Matthews; and U.S. Pat. No. 3,630,421 to Waltz.

Thus, while various forms of paper roll and tape dispensing units have been suggested in the prior art, there still is a need for an efficient and economical dispensing unit adapted to accommodate all of the most commonly used standard width masking papers (three, six, nine, twelve and eighteen inch widths) simultaneously. There is also a need for a dispensing device which can be loaded quickly and easily, which is provided with a wide base design to prevent tipping even under the worst loading conditions, and which is lightweight and designed for easy mobility without giving up the stability and durability of the heavier units currently in use.

SUMMARY OF THE INVENTION

Accordingly, it is an object of the present invention to provide a masking aprob dispensing apparatus which fulfills the above noted needs.

It is another object to provide a dispensing apparatus that is adapted to supply tape from a tape drum that is adjustable to accommodate different width tapes.

Still another object is to provide a paper and tape dispensing apparatus having a spring loaded tape adhesion guide means adapted to press a length of tape along the advancing longitudinal edge of the paper being dispensed from a roll thereof, such that the guide means provides a substantially uniform tape application pressure and acts as a brake for preventing the roll of paper from unwinding itself.

Yet another object is to provide a masking apron dispensing apparatus capable of supporting two or more rolls of paper on a single paper roll supporting shaft such that the paper from the separate rolls may be dispensed selectively or simultaneously.

Yet another object is to provide a dispensing machine of the above type which is capable of taping both of the longitudinal edges of one or more rolls of advancing paper.

In accordance with the present invention, these and other objects are accomplished by providing a masking apron dispensing apparatus comprising a relatively wide and stable base unit having a generally upwardly extending support shaft unit mounted thereto. At least one roll support unit is mounted to the support shaft unit and extends generally perpendicularly therefrom for receiving and supporting one or more rolls of masking paper. The roll support unit or units desirably define an acute angle with the horizontal such that rolls of paper supported thereon have no tendency to slide off during storage or use. Each roll support unit is provided with one or more tape dispensing units which include means for supporting a roll of masking tape adjacent an edge of a roll of paper to be dispensed, and spring loaded guide means for ensuring pressure contact between the masking tape and the paper as the tape and paper are dispensed. The spring loaded guide means also prevents unwinding or free-wheeling dipensing of the paper and tape. The dispensing apparatus is also provided with a suitable cutter bar that is mounted to each roll support unit for cutting the paper and tape to length. In preferred embodiments of the invention, the dispensing apparatus also is provided with a handle mounted on the support shaft unit and wheels mounted to the base unit to facilitate the ease of mobility of the apparatus.

These and other objects and advantages of the present invention will be appreciated and understood more fully from the following description of a preferred embodiment thereof selected for the purposes of illustration and shown in the accompanying drawings, in which.

DESCRIPTION OF THE PREFERRED EMBODIMENTS

Figure 1:
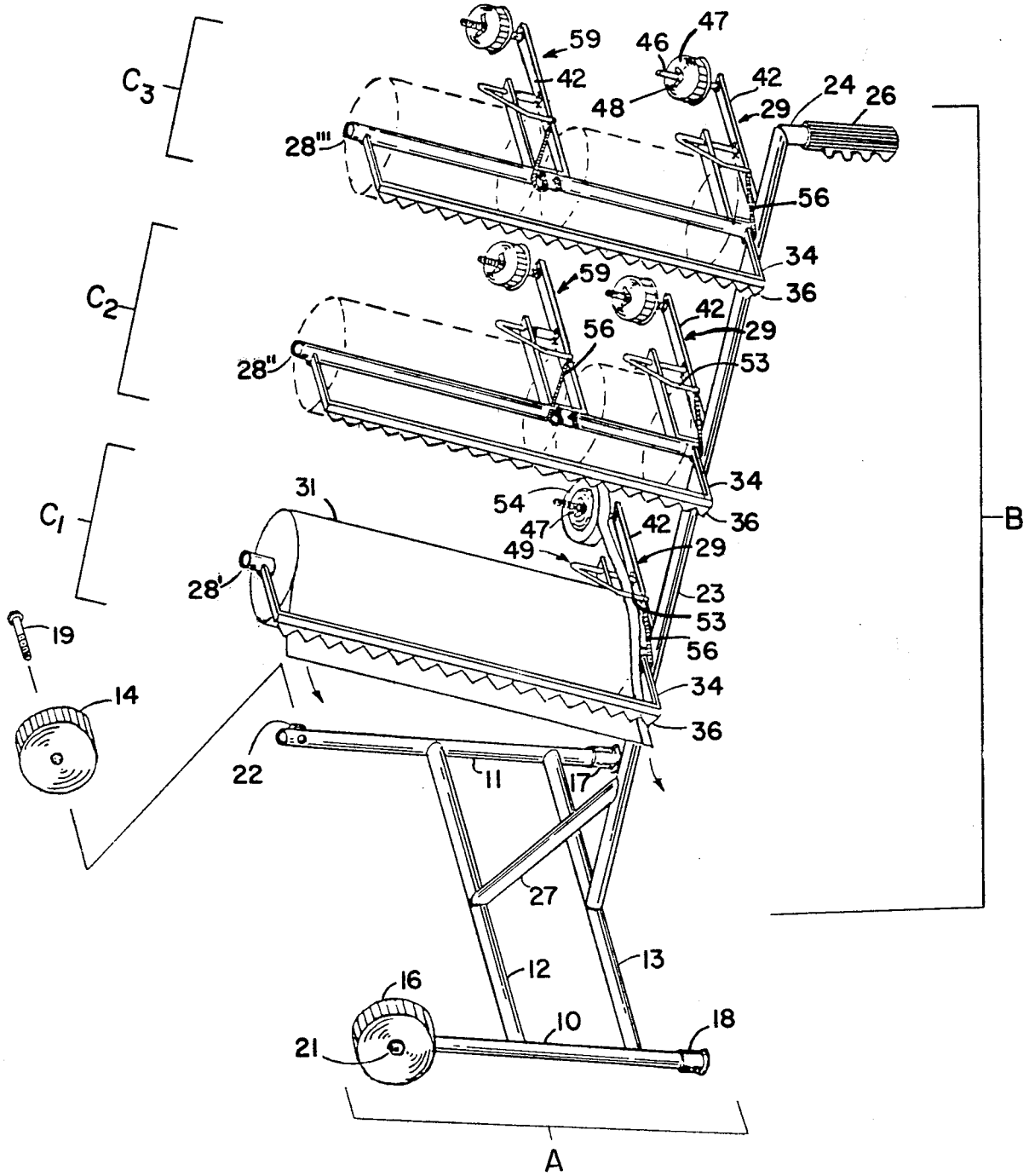
FIG. 1 is a partially exploded perspective view of one embodiment of a masking apron dispensing apparatus according to the present invention.

Referring now to the drawings and particularly to FIG. 1, there is shown a masking apron dispenser comprising a base unit A, a support shaft unit B, and three paper roll support units $C_1$, $C_2$ and $C_3$. The base unit A may comprise various configurations so long as it provides a sufficiently wide stance to ensure the stability of the dispenser. Thus, the base unit A may comprise primary tubular metal support members 10, 11 and secondary tubular metal support members 12, 13 which are disposed in the same plane as the primary members and which are suitably secured thereto, for example, by welds (not shown).

The primary support members 10, 11 are provided at one end thereof with wheels 14, 16, respectively, and may be capped with rubber or plastic cap members 17, 18 on their other end. The wheels 14, 16 may be secured in place by conventional shoulder bolt wheel axles 19, 21 fitted through an axial bore passing through the center of each wheel and through a bore passing through each primary support member. The shoulder bolt wheel axles 19, 21 may be secured in place by threading them into a wheel axle retaining nut 22 (only one shown) which is welded to each primary support member in proper alignment with the axle-receiving bore. It will be understood that the wheels 14, 16 elevate one end of the base unit A such that the primary and secondary support members lie in a plane disposed at a slight acute angle relative to the plane supporting the base unit so as to provide better stability to the apparatus when it is free standing and to provide greater ease of maneuverability.

The support shaft unit B comprises a generally upwardly extending tubular metal support shaft or member 23, a handle 24 extending from the support member 23 and a conventional rubber grip 26 slidably mounted over the handle 24 to provide an operator easy manipulation of the apparatus.

The support member 23 is secured at one end thereof to the central portion of the secondary support member 13 of the base unit A, for example, by means of a weld such that the support member 23 extends generally perpendicular to the plane defined by support members of the base unit. The other end of the support member 23 is welded to the handle 24. The support shaft unit B further comprises a diagonal brace bar 27 which is welded at one end to the support member 23 and at the other end to the secondary base support member 12. The diagonal brace bar considerably reinforces the stability of the support shaft unit B.

Each of the paper roll support units $C_1$, $C_2$ and $C_3$ comprises a paper roll receiving a supporting shaft 28', 28'', 28''', respectively. The paper roll shafts are of equal length and, as discussed more fully hereinbelow, each is provided with at least one roller bar assembly mechanism 29. Each of the shafts 28', 28'' and 28''' is mounted to the upwardly extending member 23 of the support unit B and each extends generally perpendicularly therefrom so as to define a slight acute angle with the plane supporting the base unit. This slight acute angle facilitates placing rolls of paper on the respective shaft units and eliminates any unintentional sliding of a roll of paper therefrom.

Figure 5:
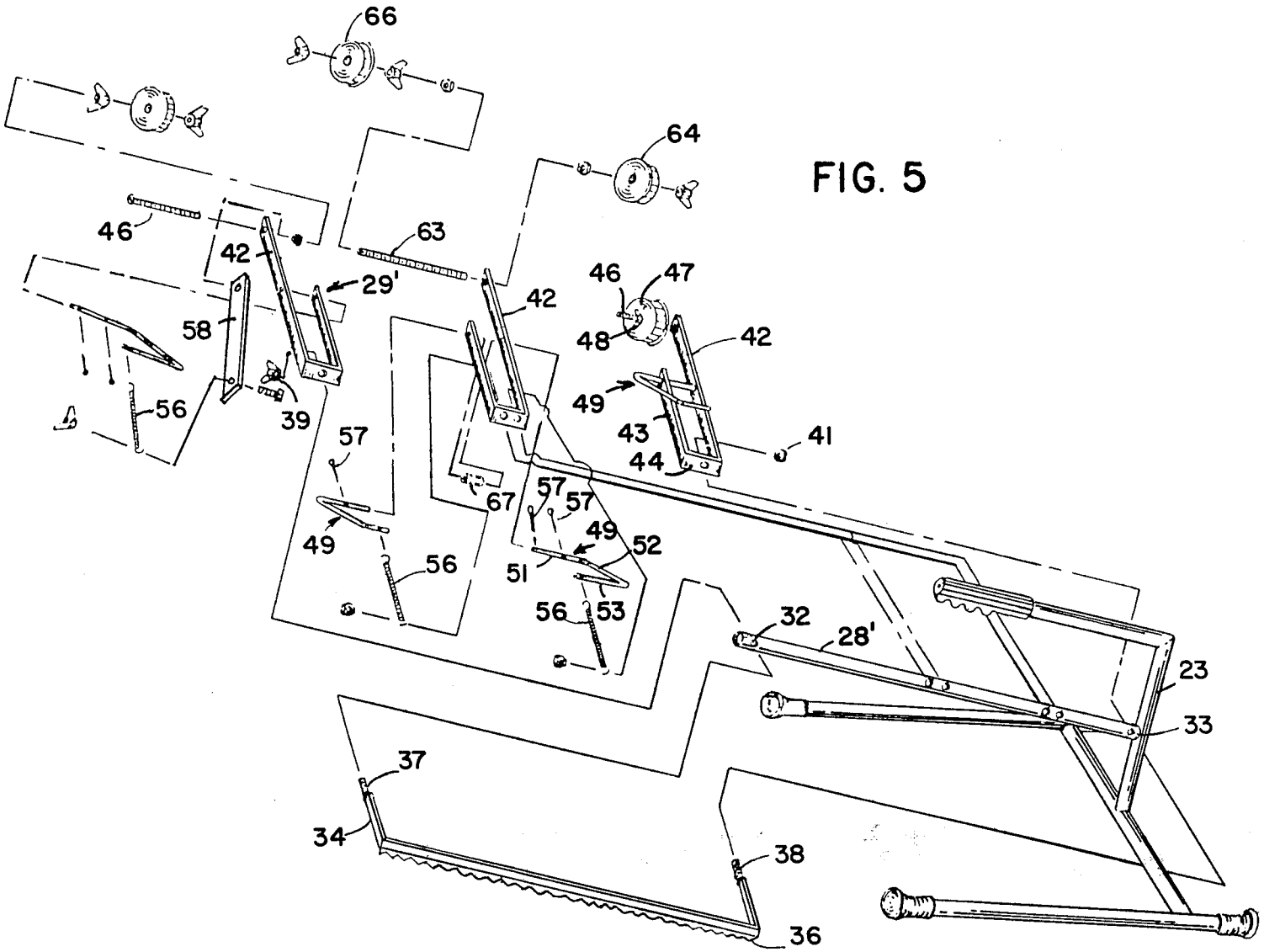
FIG. 5 is a fully exploded view of the apparatus shown in FIG. 4.

Although FIGS. 1 and 5 relate to alternative embodiments of the present invention, it will be noted the roll support unit $C_1$ shown in FIG. 1 has many elements in common with the roll support unit shown in FIG. 5. Accordingly, the same numerical designations have been used in FIGS. 1 and 5, where appropriate, so as to enhance the understanding of the elements involved. Thus, referring to FIGS. 1 and 5, the paper roll unit $C_1$ comprises a tubular metal shaft 28' of appropriate length and diameter to accommodate a roll of masking paper 31 of up to eighteen inches in width. The tubular metal shaft 28' is welded or otherwise secured to the upstanding support member 23 and is provided with a hole 32 (FIG. 5) drilled in a first end thereof and a hole 33 drilled in the other end thereof. A generally U-shaped cutter bar assembly 34 having a serrated metal edge 36 is suitably mounted to the shaft 28' to provide a cutting edge to facilitate tearing off the desired length of masking paper and tape after they have been dispensed. One convenient method for mounting the cutter bar 34 to the shaft 28' is to weld bolts 37, 38 (FIG. 5) to the ends of the cutter bar 34 and to insert the bolts through the drilled holes 32, 33 in the shaft 28'. A wing nut 39 (FIG. 5) or a hexagonal nut 41 (FIG. 5) may then be fastened on each respective bolt 37, 38 to retain the cutter bar 34 in place.

The roller shaft unit $C_1$ also comprises a roller bar assembly mechanism 29 which is mounted at the end of the shaft 28' that is secured to the support member 23 of unit B. As shown most clearly in FIG. 5, the roller bar assembly mechanism 29 may comprise a generally U-shaped metal frame having side legs 42 and 43 and a bottom leg 44. The mechanism 29 may be welded to the shaft 28'. In the alternative, the mechanism 29 may be fastened to the shaft 28' by providing a hole through the bottom leg 44 and positioning the leg against the shaft 28' such that the hole in the leg is aligned with the hole 33 drilled through the shaft. The bolt 38 then may be passed through both the shaft and the roller bar mechanism 29 and the entire assembly then may be secured in place by means of the hexagonal nut 41.

The roller bar assembly mechanism 29 also comprises a tape supporting axle 46 that is welded or otherwise secured to the side leg 42 of the mechanism 29. In one embodiment (FIG. 1) the axle may comprise a threaded bolt welded or otherwise fastened to the leg 42 such that a tape receiving drum or capstan 47 may be rotatably secured on the axle, for example, by means of a wing nut 48.

The mechanism 29 also comprises a spring loaded guide means comprised of a U-shaped member 49 having legs 51, 52 and 53 (FIG. 5). During use, the leg 53 is pressed into engagement with the tape being dispensed from the roll 54 mounted on the tape drum 47 by means of a spring 56. The pressing action of the leg 53 on the tape forces the tape against the paper roll 31 and thereby assures adhesive contact. This pressure on the tape and paper also acts as a brake to prevent the paper from unwinding unintentionally.

As shown most clearly in FIG. 5, the spring loaded guide member 49 may be mounted for pivotal movement by sliding the leg 51 of the guide member through appropriately disposed bores in legs 43 and 42 of the U-shaped frame of the roller bar assembly mechanism 29. Cotter pins 57 may be passed through holes drilled through leg 51 of the guide means to prevent the guide means from becoming disengaged from the mechanism. The spring 56 may be connected at its first end to the leg 53 of the guide means by passing its hook-shaped terminus through a hole drilled in the leg 53. The second end of the spring may be wrapped partially around the shaft 28′ and secured over the bolt 38 by means of the same hexagonal nut 41 that secures the cutter bar 34 and roller bar mechanism 29 in place.

Figure 4:
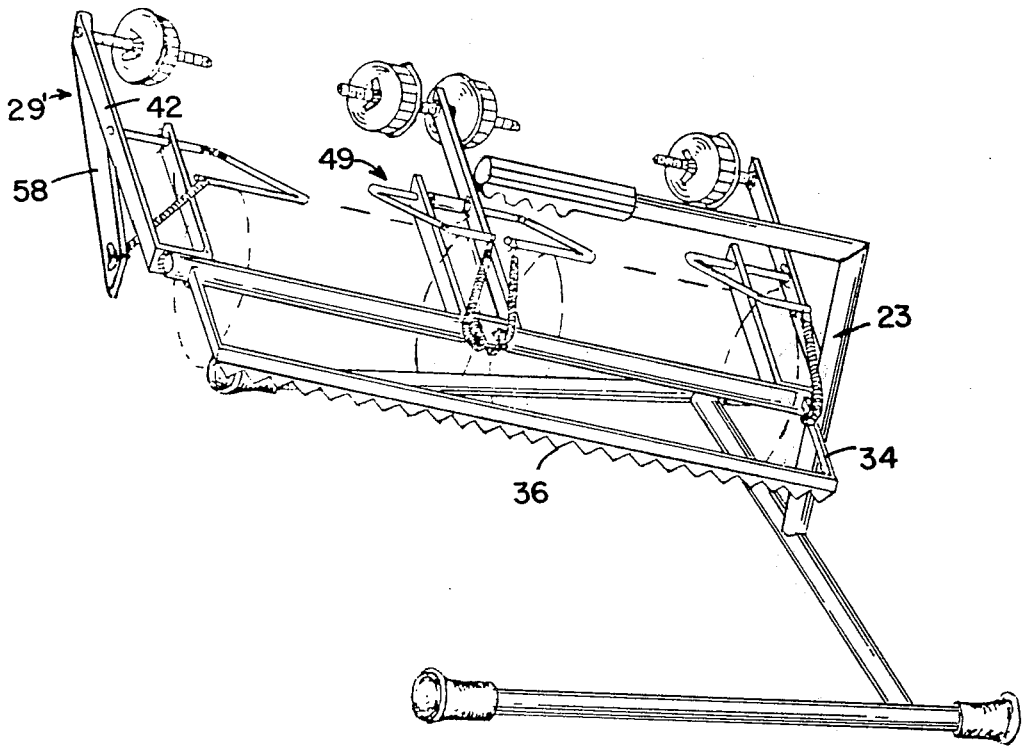
FIG. 4 is a perspective view of an apparatus similar to that shown in FIG. 2, for applying tape to both edges of the paper being advanced from two separate rolls; and figure illustrating an alternative embodiment of the spring loaded guide means of the invention.

In an alternative embodiment, as shown in the left-most portion of FIGS. 4 and 5, the second end of the spring 56 may be connected to a suitable disposed bre in a support arm 58 which is fixedly secured to the leg 42 of the U-shaped frame of the mechanism 29′.

The paper roll shaft unit $C_2$ combines all of the features included in the paper roll shaft unit $C_1$ with an additional feature: namely; the addition of roller mechansim 59 which is in all essential respects indentical to the roller mechanism 29. Attaching both the roller mechanism 59 and the roller mechansim 29 on shaft 28″ enables the utilization of two masking paper rolls on the same support shaft. For example, by appropriately spacing the mechanisms 29 and 59 both three inch width and twelve inch width rolls of paper can be supported on the shaft 28″ at the same time.

SImilarly, roll shaft unit $C_3$ combines all the features included in the paper roll shaft $C_1$ with the additional roller bar assembly mechanism 59. Attaching the roller bar assembly mechanism 59 to the paper roll shaft 28″″ allows for the utilization of masking paper rolls of both six inch and nine inch widths on the paper roll shaft 28‴.

In connection with units $C_2$ and $C_3$, it will be appreciated that the shafts 28‴ are provided with appropriately spaced holes drilled therethrough and that bolts are passed through the holes and through the bottom legs of the mechanisms 59 to secure them in place. The bolts that are used to secure the mechanisms 59 in place also secure one end of the spring 56 to the shafts 28″ and 28‴.

Figure 3:
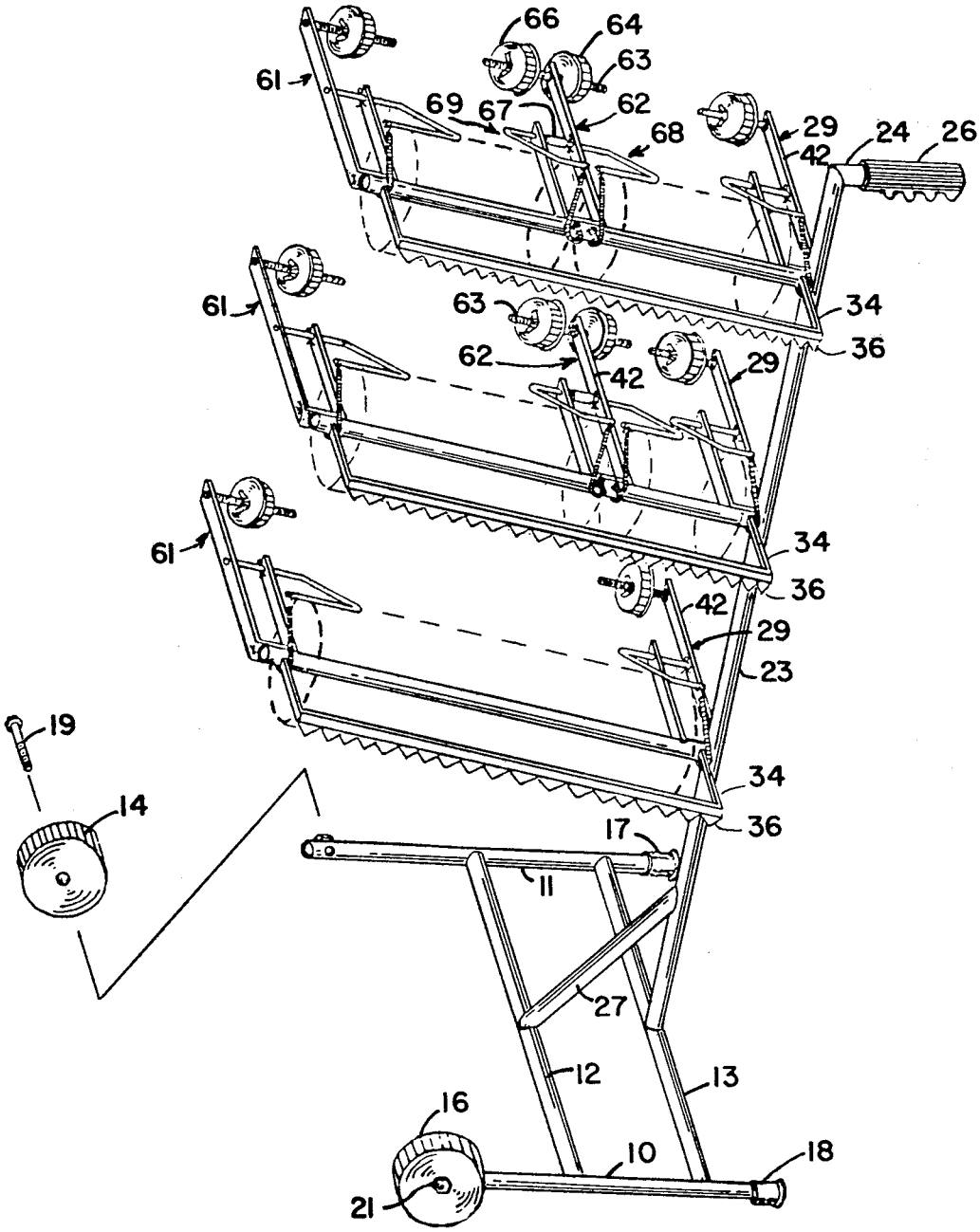
FIG. 3 is a partially exploded perspective view of an apparatus similar to that shown in FIG. 1, for applying tape to both edges of the paper being dispensed.

It is sometimes desirable to adhere tape to both edges of the paper as it is being dispensed. To this end, the previously described embodiments of the invention can be modified as shown in FIGS. 3 and 4. Referring to FIG. 3, there is shown an apparatus which is substantially the same as that shown in FIG. 1, except that single roller bar assembly mechanisms 61 have been added to the previously free ends of shafts 28″, 28″ and 28‴, respectively, and double roller bar assembly mechansims 62 have been added to shafts 28″ and 28‴, respectively, in place of single mechansims 59.

The roller bar assembly mechansims 61 are the mirror images of the mechanisms 29 and require no further description. Accordingly, it should be evident that the addition of mechanism 61 to shaft 28′ enables the adhesion of tape to both edges of a roll of masking paper of eighteen inch width when used in combination with the roller bar assembly mechanism 29.

Similarly, the addition of roller bar assembly mechanism 61 to support shaft 28″, and the replacement of mechanism 59 with a dual mechanism 62 enables the selective attachment of masking tape to both edges of a three inch wide masking paper and a twelve inch wide masking paper; whereas the addition of mechansim 61 to support shaft 28‴ and the replacement of mechansim 59 with dual mechanism 62 enables the selective attachment of masking tape to both edges of separate six inch width and nine inch width rolls of masking paper.

The dual roller bar assembly mechansims 62 are identical and can be made by modifying the single roller bar mechansims 29 and 59. Thus, by simply repplacing the bolt 46 that is used for the tape axle for the single roller bar mechanisms with a threaded rod 63, two tape drums 64 and 66 can be attached to the leg 42 of the U-shaped frame. The dual roller bar assembly mechansims also require the use of two independently moving tape guide means which can be made by modifying the guide means previously described. For example, the leg 51 of the U-shaped member may be shortened slightly and inserted through the bore in leg 43 of the U-shaped frame and partially into a sleeve 67 which is disposed between the legs 42 and 43 of the frame. Another U-shaped member, with its leg 51 similarly shortened, may be inverted 180° so that the leg 51 is passed through the bore in leg 42 of the U-shaped frame and partially into the sleeve 67. The legs 53 of the two guide members may then be connected to the support shafts 28″ and 28‴ by means of two separate springs 56 in the manner previously described. Of course, the leg 44 of the U-shaped frame would be provided with two drilled holes, one for mounting each spring.

Figure 2:
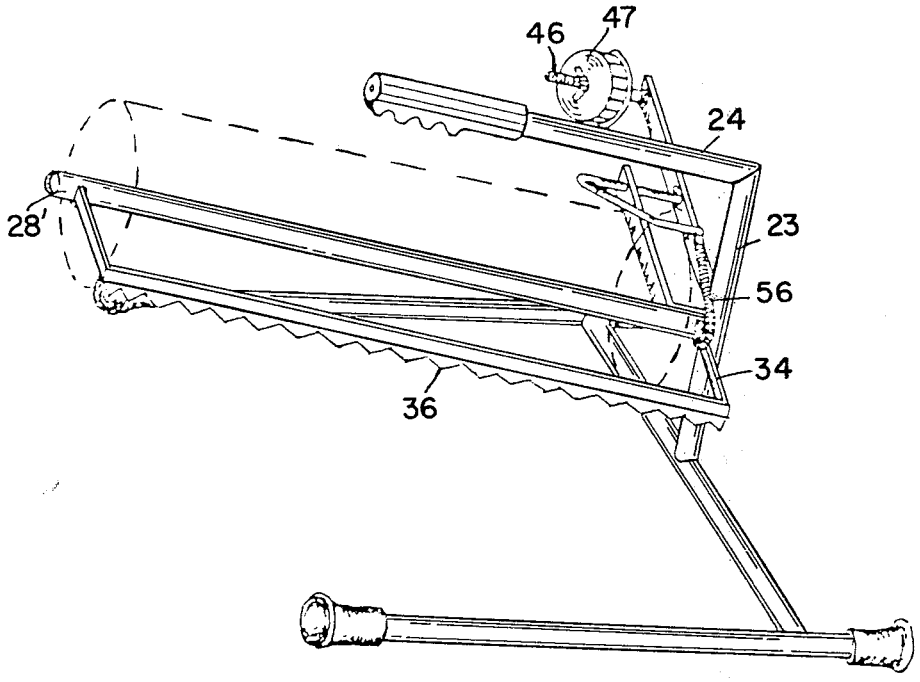
FIG. 2 is a perspective vie of a hand-carried apparatus with a modified base unit.

The embodiments illustrated in FIGS. 2, 4 and 5 correspond generally to those of FIGS. 1 and 3, except that they are much smaller and are designed to be hand-carried. The individual components of these embodiments, with the exception of the base and handle configurations, are the same as those described in connection with FIGS. 1 and 3 and do not require further elaboration.

OPERATION

In order to afford a better understanding of the apparatus a more detailed description of operation is given below. Referring to FIG. 1, a roll of masking tape 54 is placed onto the tape drum 47. The end of the blade bar 34 which is attached to the free end of the paper roll shaft 28′ is then removed and an appropriately sized roll of masking paper is placed onto the paper roll shaft. The beginning strip of masking paper is then attached to the edge of the masking paper as shown in FIG. 1. As the masking paper is pulled under the cutting blade bar in the direction of the arrows, the tapered edge of the masking paper passes under the leg 53 of the spring loaded tape adhesion guide. The spring loaded tape adhesion guide applies pressure to the taped edge of masking paper to create the necessary bond between paper and tape.

The single roller bar assembly mechanism 29 incorportes three functions into one mechanism: (1) the drum 47 holds a roll of pressure sensitive tape of up to two inches in width, (2) the tape adhesion guide applies pressure to the tape and paper to insure an adequate bond between the two, and (3) the entire mechanism acts as a divider between rolls of paper to allow independent movement as shown by mechanisms 29 and 59 (FIG. 1).

The dual roller bar assembly mechanism as shown in FIG. 3 incorporates the same three functions of the single roller bar assembly mechanism with an additional function: namely; the application of tape to edges of two separate rolls of masking paper. Replacing the bolt 46 (FIG. 1) with a threaded rod 63 (FIG. 3) enables the operator to attach two tape drums 64 and 66 to the roller assembly bar mechanisms 62. Then the tape adhesion guide used on a single roller bar assembly mechanism, for example, 59 shown in FIG. 1, is replaced by two independently moving tape adhesion guides 68 and 69 (FIG. 3). The operating procedures previously described apply to both the single and dual roller bar assembly mechanisms.

It is to be understood that the above-described embodiments are simply illustrative of the principles of the invention, and that various other modifications and changes may be devised by those skilled in the art which will embody the principles of the invention and fall within the spirit and scope thereof.

What is claimed is:

1. A tape and masking apron dispensing apparatus for rolls of paper and tape comprising:

a base unit;

a supporting unit attached to said base unit and extending generally upwardly therefrom; and at least one paper roll shaft unit attached to said support unit; each paper roll shaft unit comprising (a) a shaft for receiving and supporting at least one roll of paper, said shaft being connected to said support unit and extending generally perpendicularly therefrom such that the axis of each supported roll of paper forms an acute angle with the plane supporting said base unit, (b) cutter bar means mounted to said shaft for cutting dispensed tape and paper to length, and (c) at least one roller bar assembly means mounted to said shaft (i) for retatively supporting at least one roll of pressure sensitive tape, (ii) for pressing the tape against a longitudinally advancing edge of the paper as the paper and tape are dispensed, and (ii) for providing a positive spacing means betweeen adjacent rolls of paper and tape when more than one roll of paper and tape are supported on a single shaft, thereby permitting independent dispensing and taping of the individual rolls of paper.

2. The apparatus of claim 1, wherein at least one of said paper roll receiving and supporting shafts has two roller bar assembly means mounted thereto.

3. The apparatus of claim 2, wherein at least one of said paper roll receiving and supporting shafts supports two axially spaced rolls of paper, and wherein at least two roller bar assembly means are mounted to said shaft such that a first of said roller bar assembly means rotatably supports tape which is to be pressed onto a longitudinally advancing edge of a first of said rolls of paper and the second of said roller bar assembly means rotatably supports tape which is to be pressed onto a longitudinally advancing edge of the second roll of paper, said first and second rolls of paper being independently and selectively dispensible.

4. The apparatus of claim 3, comprising a plurality of paper roll receiving and supporting shafts of substantially equal length.

5. The apparatus of claim 2, wherein at least one of said paper roll receiving and supporting shafts supports two axially spaced rolls of paper, wherein at least one of said roller bar assembly means is mounted to said shaft at an axial location between said spaced rolls of paper, and wherein the so located roller bar assembly means rotatably supports two axially spaced and independently rotatable rolls of tape such that the tape from a first of said spaced rolls of tape is pressed against a longitudinally advancing edge of a first of said spaced rolls of paper and the tape from the second of said spaced rolls of tape is pressed against a longitudinally advancing edge of the second of said spaced rolls of paper, said first and second rolls of paper being independently and selectively dispensible.

6. The apparatus of claim 5, comprising a plurality of paper roll receiving and supporting shafts of substantially equal length.

7. The apparatus of claim 5, wherein roller bar assembly means are mounted to at least one of said paper roll receiving and supporting shafts such that each longitudinal edge of at least one roll of paper supported on said shaft has a roll of tape in pressing engagement therewith, whereby both longitudinally advancing edges of said at least one roll of paper will be taped as said one roll of paper is dispensed.

8. The apparatus of claim 7, comprising a plurality of paper roll receiving and supporting shafts of substantially equal length.

9. The apparatus of claim 1, wherein said roller bar assembly means including spring loaded tape guide means for pressing the tape against the paper as the paper and tape are dispensed, said spring loaded guide means being free from any direct connection to said support unit.

10. The apparatus of claim 9, wherein said spring loaded guide means is connected directly to said paper roll receiving and supporting shaft.

11. The apparatus of claim 1, wherein said base unit is provided with wheels to facilitate the mobility thereof.

12. The apparatus of claim 1, wherein said support unit includes a handle extending therefrom at an elevation above the axis of the uppermost paper roll receiving and supporting shaft.

13. The apparatus of claim 1, comprising a plurality of paper roll receiving and supporting shafts of substantially equal length, at least one of said shafts supporting two axially spaced rolls of paper.

* * * * *